US005173170A

United States Patent [19]

Brown et al.

[11] Patent Number: 5,173,170

[45] Date of Patent: Dec. 22, 1992

[54] PROCESS FOR ELECTROPLATING METALS

[75] Inventors: Craig J. Brown, Pickering; Antonio G. Mazza, Downsview, both of Canada

[73] Assignee: Eco-Tec Limited, Pickering, Ontario, Canada

[21] Appl. No.: 709,479

[22] Filed: Jun. 3, 1991

[51] Int. Cl.[5] ..... C25D 21/12

[52] U.S. Cl. ..... 205/96; 205/101; 205/270

[58] Field of Search ..... 204/194, DIG. 7, 231, 204/290 F, 14.1, 252, 293, 270, 278, 267; 205/96, 101, 270

[56] References Cited

U.S. PATENT DOCUMENTS

| | | | |
|---|---|---|---|
| 2,511,395 | 6/1950 | Baier et al. | 205/96 |
| 3,511,758 | 5/1970 | Bedi | 204/231 X |
| 3,560,349 | 2/1971 | Mattia | 204/231 X |
| 3,573,175 | 3/1971 | Bedi | 204/231 X |
| 3,959,099 | 5/1976 | Froman et al. | 204/231 X |
| 4,490,218 | 12/1984 | Kadija et al. | 204/231 X |
| 5,049,246 | 9/1991 | Hull et al. | 204/231 X |

*Primary Examiner*—Donald R. Valentine
*Attorney, Agent, or Firm*—Bereskin & Parr

[57] ABSTRACT

An electroplating cell having soluble and insoluble anodes is provided with a primary power supply having a positive terminal connected to the soluble anodes and a negative terminal connected to a cathode including workpieces to be plated. An auxiliary power supply has a positive terminal connected to the insoluble anodes and a negative terminal connected to the negative terminal of the primary power supply so that the voltage applied to the insoluble anode is equal to the sum of the voltages applied by the two power supplies.

5 Claims, 2 Drawing Sheets

PROCESS FOR ELECTROPLATING METALS

FIELD OF THE INVENTION

This invention relates to a process for electroplating metals.

BACKGROUND OF THE INVENTION

Electroplating is a well known process for applying metal coatings to an electrically conductive substrate. The process employs a bath filled with a metal salt containing electrolyte, at least one metal anode and a source of direct electrical current such as a rectifier. A workpiece to be plated acts as a cathode. While processes for plating some metals, notably chromium, employ insoluble anodes such as lead alloy, most processes utilize soluble anodes of the metal being plated.

In a typical plating operation, a series of metal anodes are hung from one or more anode bus bars while workpieces to be plated are immersed in the plating bath and attached to a cathode bus bar. The negative terminal of a DC power supply is connected to the cathode bus bar while the positive terminal of the power supply is connected to the anode bus bar. The voltage is adjusted at the power supply to provide a current density on the cathodic workpieces which is considered optimal.

The metal anodes dissolve with use and are replaced from time to time. In many electroplating operations, the dissolved metal concentration in the electroplating solution has a tendency to increase beyond the concentration considered optimal for electroplating, due to the fact that the cathode efficiency is less than the anode efficiency. In other words, metal dissolves from the anodes faster than it plates at the cathodes.

U.S. Pat. No. 4,778,572 (Brown) shows a method of resolving this imbalance between anode and cathode efficiencies. According to this invention, some of the soluble anodes are replaced with insoluble anodes. These insoluble anodes are connected to the same anode bus bar as the soluble anodes and therefore operate at the same electrical potential or voltage. The amount of insoluble anode material employed is such that the current carried by the insoluble anodes is equal to the amount of current that results in the production of hydrogen gas at the cathode.

One problem with using insoluble anodes is that the electrode potential required for evolution of oxygen at insoluble anodes is greater than the electrode potential required for dissolution of metal from soluble anodes. As a result, the current density obtained from the insoluble anodes is significantly lower than that obtained from the soluble anodes when operated at the same overall applied voltage. The reduction in voltage drop across the solution at the reduced current density compensates for the higher electrode potential. Consequently, a greater quantity of insoluble anode material is required to carry a given current than would otherwise be the case. This problem is exacerbated by the use of ion exchange membranes in conjunction with the insoluble anodes, as outlined in the '572 patent, due to the voltage drop across the membrane. A further disadvantage of the lower current density obtained by insoluble anodes is uneven current distribution and resulting uneven thickness of metal deposited on the cathodic workpieces. The cathodic current density and deposit thickness are somewhat less at locations across from insoluble anodes than would be the case at the same locations if soluble anodes had been employed.

In actual operation the electrode potential is approximately equal to that component of the total potential difference between the anode and cathode which pertains to the reaction at the electrode only. For example, in the case of an anode, the anode electrode potential would exclude voltage losses due to solution resistance and plating of metal at the cathode.

For some electroplating processes, an insoluble anode installed along with soluble metal anodes at the same electrical potential will carry no current whatsoever. This is said to occur with copper electroplating, for example. In such cases, it is necessary to apply a higher electrical potential to the insoluble anodes than to the soluble anodes, in order to obtain current flow through the insoluble anode. This is normally accomplished through use of a second auxiliary power supply in addition to the first primary power supply. One method of employing an auxiliary power supply for this purpose is outlined in Japanese patent application SH056-112500.

An analogous problem occurs with alloy plating systems. Where it is desired to simultaneously electroplate two different metals simultaneously such as iron and nickel to produce an alloy coating, it is necessary to provide a means of replenishing the metal content of the solution. The simplest approach is to hang separate soluble anodes of the two metals on the same bus bar. Such systems are seldom practical unless the metals have approximately the same electrode potential. For most metal combinations, the electrode potentials are different so that one metal is almost sure to act as an inert anode. Different bus bars and rectifiers can be used for each metal. However, it is difficult to maintain the correct amount of current to each anode type as the total current requirements of the bath change with variation in the size of the cathode work load.

In hoist type plating operations, a certain period occurs during the plating cycle, as well as during plant shutdowns, where there are no parts being plated in the plating bath. During this time a battery effect is experienced, whereby a potential is set up between the soluble anodes and the insoluble anodes. The soluble anodes remain anodic while the insoluble anodes take on a cathodic charge. This is disadvantageous, since many insoluble anode electrode substrates such as lead alloys and titanium, depend on the formation and maintenance of a stable oxide film on the electrode surface for corrosion resistance. When charged cathodically, this oxide film breaks down, resulting in corrosion of the anode and premature loss of effective life. For example, failure of iridium oxide coated titanium anodes has been experienced in nickel plating field tests in periods of less than three months when continuous accelerated laboratory life tests had predicted several years life. This premature insoluble anode failure severely restricts or precludes the use of these insoluble anode materials in many cases.

BRIEF DESCRIPTION OF THE INVENTION

An object of the present invention is to provide an improved process for electroplating metals which allows for an increased voltage to be applied to one of the two anodes.

The invention provides a process for electroplating metals which comprises the steps of providing a bath containing a plating solution of a metallic salt, a cathode comprising a workpiece to be plated, and first and second anodes. The process also includes the steps of (a) connecting a positive side of a first direct current source to the first anode and the negative side of that source to the cathode and (b) connecting a negative side of a second direct source to the positive side of the first direct current source and a positive side of the second direct current source to the second anode. The voltage of the first source is selected to obtain a desired reaction at the first anode and the voltage of the second current source is selected to achieve a desired reaction at the second anode.

It will be appreciated that the invention provides a simple method of incrementally increasing the voltage to the second anode by a constant amount to compensate for the higher electrode potential of the second anode reaction compared to the first anode reaction, regardless of the total voltage being applied by the first direct current source. For example, in an embodiment in which one or more insoluble anodes are used, the "second" anode referred to previously will comprise one or more insoluble anodes and will receive a voltage that is incrementally higher than the voltage applied to the soluble anode or anodes.

BRIEF DESCRIPTION OF DRAWINGS

In order that the invention may be more clearly understood, reference will now be made to the accompanying drawings which illustrate particular preferred embodiments of the invention by way of example, as compared with the prior art. In the drawings.

DESCRIPTION OF THE PRIOR ART

Figure 1:
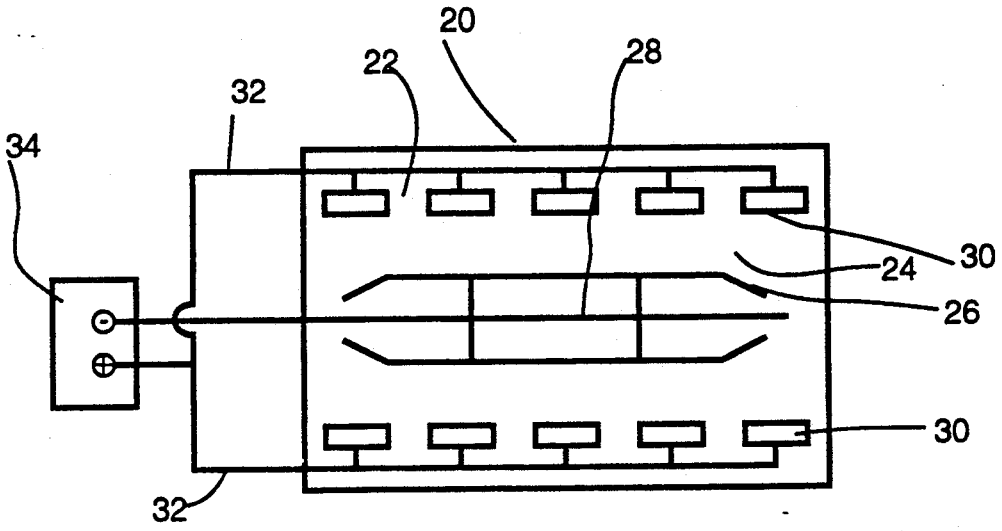
FIGURE 1 (PRIOR ART)
FIGS. 1 and 2 are simplified schematic plan views of prior art electroplating cells illustrating, respectively, typical arrangement using a single DC power supply, and an arrangement in which an auxiliary power supply is used in conjunction with insoluble anodes.

Referring first to FIG. 1, a conventional electroplating bath is denoted by reference numeral 20 and is shown containing a plating solution 22 of a metallic salt. Immersed in the plating solution 22 is a cathode 24 comprising workpieces 26 to be plated. The workpieces are attached to a cathode bus bar 28. Respective series 30 of anodes are also immersed in the bath on opposite sides of the cathode and are hung from respective anode bus bars 32. The cathode bus bar 28 is connected to the negative side of a DC power supply 34 while the anode bus bars 32 are connected to the positive side of the same supply.

Figure 2:
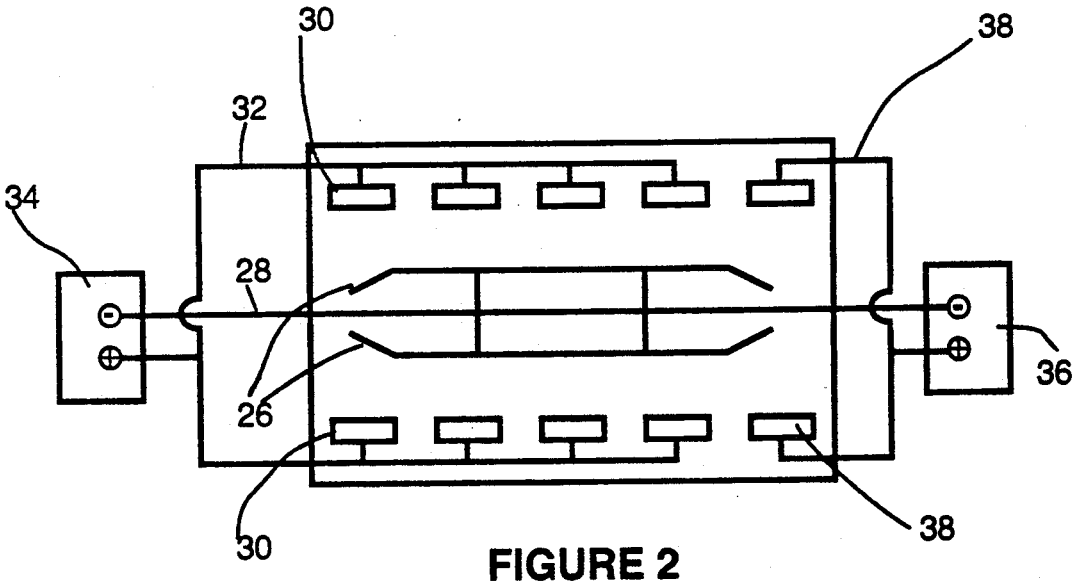
FIGURE 2 (PRIOR ART)
Figure 3:
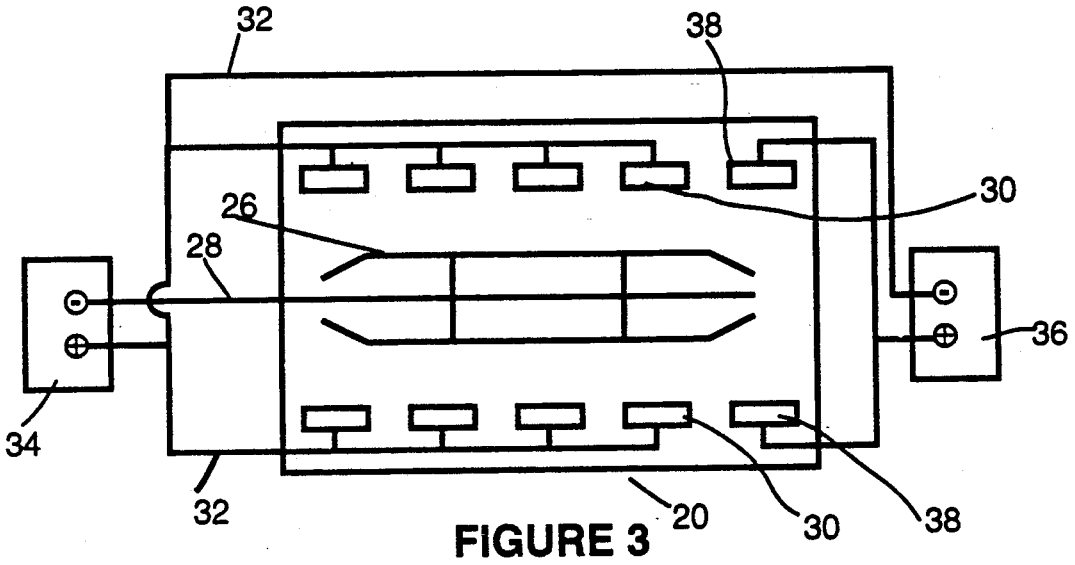
FIG. 3 is a simplified schematic plan view of an electroplating cell similar to the cell of FIG. 2 but provided with primary and auxiliary power supplies in accordance with the invention; and, FIG. 4 is a view similar to FIG. 1 illustrating the use of anode "bags" around the soluble anodes.
Figure 4:
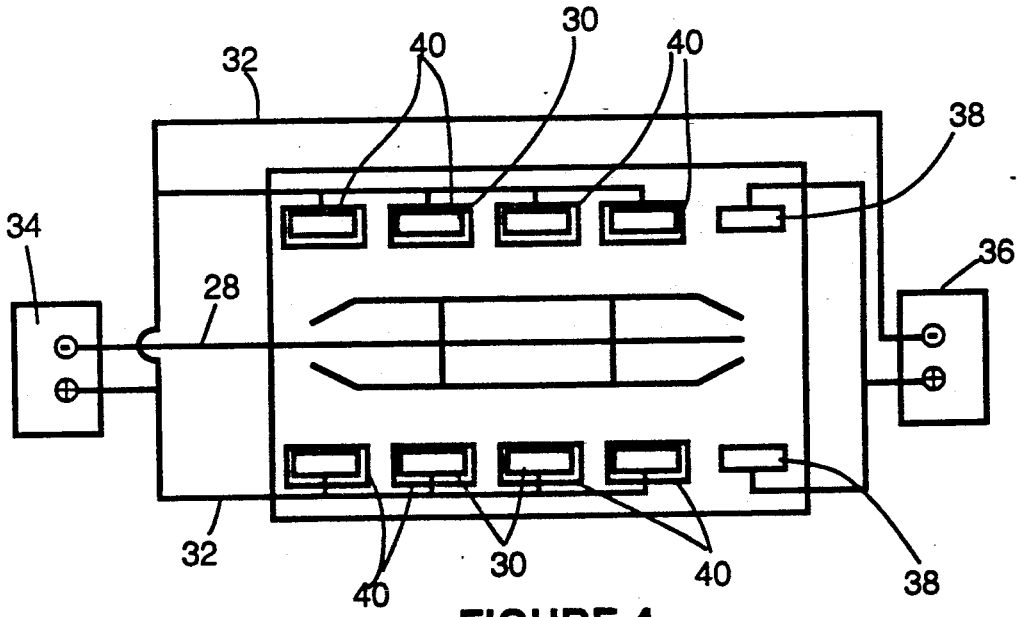

In FIGS. 2, 3 and 4, reference numerals similar to those used in FIG. 1 have been used to denote similar parts.

FIG. 2 illustrates the normal method of electrical connection of an auxiliary power supply 36 with a pair of insoluble anodes 38 in a plating bath. The negative connections from both power supplies 34, 36 are connected together and to the cathode. The positive connection from the main power supply 34 is connected to the soluble anodes 30 and the positive connection from the auxiliary power supply 36 is connected to the insoluble anodes 38. In another arrangement, a single power supply could be employed for both soluble and insoluble anodes. In this case a resistive load would be connected in series with the soluble anodes to reduce the voltage to the soluble anodes. This latter arrangement is very inefficient from an energy standpoint as a considerable amount of power is lost to the resistive load.

A typical plating bath may operate at a potential of, say 10 volts. This will be the voltage (E1) of the primary power supply 34. Since the electrode potential required for oxygen evolution at the insoluble anodes (indicating that the anodes are carrying current) is typically about 1.5 volt higher than the potential required for metal dissolution at the soluble anodes, the auxiliary power supply will need to operate at a voltage (E2) of about 1.5 volts higher than the primary power supply, say 11.5 volts. This allows the insoluble anode current density to be increased to a level comparable to that at the soluble anodes, or beyond. The major disadvantage of this approach is the additional capital cost of the auxiliary power supply and its controls.

DESCRIPTION OF THE PREFERRED EMBODIMENTS

FIG. 3 shows the auxiliary power supply 36 connected to the anodes 30, 38 and to cathode 24 according to this invention. In this arrangement, the negative terminal of the auxiliary power supply 36 is connected to the positive terminal of the primary power supply 34 and also to the soluble anode bus bars 32, while the positive terminal of the auxiliary power supply 36 is connected to the insoluble anodes. As a result of this connection, the soluble anodes 30 are anodic to the cathode work pieces 26 by a voltage equal to the voltage E1 (e.g. 10 volts) of the main plating power supply 34. The insoluble anodes 38 are also anodic to the cathode, but at a voltage equal to the sum of the voltages of the primary power supply 34 and the auxiliary power supply 36 (ie. E1 +E2). If a voltage of 11.5 volts is sought at the insoluble anodes, the voltage requirement of the auxiliary power supply is 1.5 volt. This represents a substantial reduction compared to the prior art arrangement discussed above, which would require an 11.5 volt auxiliary power supply. In the invention, the voltage of the auxiliary power supply will usually be lower than the voltage of the primary power supply, in contrast to the prior art where the voltage of the auxiliary power supply will always be higher than the voltage of the primary power supply.

The exact electrode potentials of the anodes will not normally be measured in practice. The voltages applied by the primary and secondary power supplies will be adjusted or selected to achieve the desired reactions at the respective electrodes.

A further advantage of the invention is that, when there are no workpieces immersed in the plating bath, the insoluble anodes remain anodic to the soluble anodes. This has two effects. First, by maintaining an anodic charge on the insoluble anode in this manner at all times, anode life can be significantly extended. Second, if a sufficient potential is applied using the auxiliary power supply, a certain amount of metal will be electroplated during the plating 'off-cycle' onto the soluble anodes, since they will be "seen" as cathodes. This serves to reduce the metal concentration in the plating bath. While this is the original purpose of installing insoluble anodes, the invention allows metal reduction to continue during times of non-production, when otherwise the insoluble anodes would be non-functional.

The metal that is deposited on the soluble anodes is later dissolved during the normal plating 'on-cycle'.

Metal that is electrowon from a plating bath is sometimes not suitable for re-use in the same plating bath because of co-deposition of impurities along with the metal. This is often the case in bright nickel electroplating and may limit the usefulness of an external electrowinning technique (see e.g. U.S. Pat. No. 4,906,340 or Japan patent application SH057-51477). With the present invention, the amount of metal that is plated back on to the 'anodes' during the short plating 'off-cycle' is very small and is plated from the solution immediately surrounding the anodes. This solution adjacent to the anodes is very pure, having just been dissolved from the anodes during the previous plating 'on-cycle', so that the deposit is also of high purity. Use may also be made of a diaphragm or "anode bag" to prevent co-deposition of impurities by providing a permeable barrier between the bulk plating solution, which contains appreciable quantities of organic additives and various impurities, and a relatively pure solution or anolyte inside the bag immediately surrounding the metal anode. FIG. 4 shows how the soluble anodes 30 would be equipped with permeable bags 40 for this purpose.

The use of insoluble anodes poses a particular problem in plating solutions involving metals such as iron which can exist in two valence states, where the lower valence state is the preferred form. The preferred ferrous iron ($Fe^{++}$) reacts at the anode to be oxidized to the ferric form ($Fe^{+++}$). Prior to being reduced at the cathode to the elemental form, the iron must first be reduced back to the ferrous form from the ferric. This increases the plating electrical requirements. Furthermore, ferric iron is often insoluble at the plating bath operating pH and the resulting ferric hydroxide precipitate is objectionable in the plating bath. The use of a cation exchange membrane as outlined in the '572 patent referred to previously will isolate the iron containing plating solution from the anode to prevent iron oxidation. However, the membrane is only effective so long as a polarized condition is maintained. If the power is turned off, ferrous iron will exchange across the membrane into the anolyte by a mechanism known as Donnan dialysis. The iron present in the anode compartment upon restoration of power, will then be quickly oxidized to the ferric form before it exchanges back across the membrane out of the anode compartment. With the present invention, if the insoluble anode is equipped with a cation membrane, the anode is anodically polarized at all times so that the iron is repelled from the anode and will not exchange across the membrane, thereby minimizing oxidation of iron.

As with auxiliary power supplies employed according to the prior art, a significant benefit of this present invention is that it allows increases in the amount of current that an insoluble anode will carry when it is used in an electroplating bath along with soluble anodes. The invention also provides a means of reducing the size and cost of the second auxiliary power supply, while extending the life of the insoluble anodes and increasing its capacity for reducing the metal concentration in the plating bath. A number of additional benefits have been explained herein.

A further advantage is that adjustment of the voltage supplied by the auxiliary power supply during a plating run is unnecessary.

With the prior art auxiliary power supply arrangement as shown in FIG. 2, the primary voltage (E1) may change from one workpiece load to the next because of differences in surface area and shape. As a result of this, it would be necessary to frequently adjust the voltage of the auxiliary power supply (E2) to maintain constant the optimal voltage differential (E2−E1) between the two rectifiers. This must be done either manually or through a suitable electronic control system. With the present invention, this adjustment is not necessary since the voltage differential (E2−E1) is pre-set by the auxiliary power supply and remains constant from one work piece load to the next.

Various different materials can be employed for the insoluble anode. These materials include lead alloys, carbon, precious metal coated valve metals and low oxygen overvoltage catalyst (eg. iridium oxide) coated valve metals (eg. titanium, niobium) and valve metal oxides (eg. titanium sub-oxides). The low oxygen overvoltage catalyst coated anodes are of particular advantage, since by lowering the oxygen overpotential, the voltage of the auxiliary power supply is minimized.

It will be appreciated that, while the invention has been described primarily in the context of an electroplating cell including soluble and insoluble anodes, where the electrode potential for the insoluble anodes is higher, the invention is not limited to this particular application. For example, the invention may be applied to an alloy plating system of the form described previously in the discussion of the prior art, where the electrode potential for dissolution of each of the anode materials differs appreciably. The invention could also be used with anodes of the same material. Where soluble anodes of the same material only are used, the electrode potential of the "second" anode (i.e. the anode connected to the auxiliary power supply) will be equal to the electrode potential at the first anode. However, the voltage drop across the solution may be greater so that a higher voltage may be required to maintain the desired current density. For example, the second anode may be located at a greater distance from the portion of the workpiece onto which metal is to be plated from that anode than the corresponding distance for the first anode. Alternatively, if a thicker deposit is desired on the cathode area adjacent to the second anode, it will be necessary to increase the voltage applied to the second anode to obtain the requisite higher current density that produces the thicker deposit.

References herein to an anode or a cathode in the singular does not of course preclude the use of multiple anodes or cathodes (as the case may be) electrically connected together, e.g. by a common bus bar.

Finally, it should be noted that, while the description refers to a single auxiliary power supply, two or more such supplies could be employed where there are more than two groups of anodes that require different voltages. The negative side of each auxiliary supply would be connected to the positive side of the primary power supply and the positive side of each auxiliary supply connected to the relevant additional anode or anodes.

We claim:

1. A process for electroplating metals, comprising the steps of:

providing a bath containing a plating solution of a metallic salt, a cathode comprising a workpiece to be plated, a first anode and a second anode;

connecting a positive side of a first direct current source to said first anode and a negative side of said source to said cathode;

selecting the voltage of the first direct current source to obtain a desired reaction at said anode;

connecting a negative side of a second direct current source to the positive side of the first direct current source and connecting a positive side of the second direct current source to the second anode; and selecting the voltage of the second direct current source to achieve a desired reaction at said anode.

2. A process as claimed in claim 1, wherein the voltage applied by said second direct current source is less than the voltage applied by said first direct current source.

3. A process as claimed in claim 1, wherein the plating solution contains a metal which can exist in two valence states, the preferred form being the lower valence state.

4. A process as claimed in claim 3, wherein the plating solution contains iron salts.

5. A process as claimed in claim 1, wherein the electrode potential of the second anode is greater than the electrode potential of the first anode.

* * * * *